United States Patent [19]

Sasaki

[11] Patent Number: 4,651,801

[45] Date of Patent: Mar. 24, 1987

[54] WAX MASTER TREE FOR PRECISION CASTING

[75] Inventor: Nobuyoshi Sasaki, Yokohama, Japan

[73] Assignee: M.C.L. Co., Ltd., Japan

[21] Appl. No.: 801,379

[22] Filed: Nov. 22, 1985

Related U.S. Application Data

[63] Continuation of Ser. No. 554,360, Nov. 22, 1983, abandoned.

[30] Foreign Application Priority Data

Nov. 26, 1982 [JP] Japan ..... 57-2077311

[51] Int. Cl.[4] ..... B22C 7/02

[52] U.S. Cl. ..... 164/244; 164/34; 164/246

[58] Field of Search ..... 164/45, 361, 34, 35, 164/36, 244, 246, 249

[56] References Cited

U.S. PATENT DOCUMENTS

| | | | |
|---|---|---|---|
| 3,177,537 | 4/1965 | Horton | 164/246 |
| 3,604,496 | 9/1971 | Grosjean | 164/244 |
| 3,648,760 | 3/1972 | Cooper | 164/35 |
| 3,835,913 | 9/1974 | Vandemark et al. | 164/35 |
| 4,064,927 | 12/1977 | Ostrowski | 164/244 |
| 4,081,019 | 3/1978 | Kulig | 164/34 |
| 4,240,492 | 12/1980 | Edwards | 164/34 |

FOREIGN PATENT DOCUMENTS

| | | | |
|---|---|---|---|
| 1364978 | 8/1974 | United Kingdom | 164/34 |

*Primary Examiner*—Nicholas P. Godici
*Assistant Examiner*—G. M. Reid
*Attorney, Agent, or Firm*—Laff, Whitesel, Conte & Saret

[57] ABSTRACT

An improved wax master tree used for precision casting is provided. The tree comprises a sprue rod and a plurality of wax masters attached to the sprue rod by fusing. In the improved wax master tree of the invention, the sprue rod is made of a substantially rigid material having a sufficient mechanical strength and withstanding to retain its integrity during the dewaxing step, and has a contour of generally tubular shape with the wall provided with a number of pores and covered with a wax covering layer. The rigidity of the tubular member ensures easy handling of the tree without the fear of damage during the handling operations. By the provision of hollow core portion internally of the tubular member having a wall provided with a number of pores, the risk of cracking of the ceramic shell mold applied on the wax master tree at the dewaxing step caused by the adverse affect of thermal expansion of the wax can be avoided. In the preferred embodiment, the tubular member is made of a magnetic material, such as iron, to have a capability of being heated selectively by high frequency heating to enable easy withdrawal thereof at the initial stage of the dewaxing step to provide a flow passage for the molten wax as well as means for transferring heat from the inside of the ceramic shell mold, whereby the risk of cracking of the ceramic shell mold is further diminished.

5 Claims, 4 Drawing Figures

WAX MASTER TREE FOR PRECISION CASTING

This is a continuation of U.S. patent application Ser. No. 06/554,360, filed Nov. 22, 1983, now abandoned.

BACKGROUND OF THE INVENTION

1. Field of the Invention

The present invention relates to an improvement in wax master tree used in the lost wax casting process.

2. Prior Art

In the investment or lost-wax casting process, a so-called tree or cluster is used. The tree for this purpose is made by molding a plurality of masters for the desired products from a wax and attaching a pre-set number of wax masters to the outer peripheral wall of a sprue rod made from a wax.

However, since the sprue rod of conventional casting tree is made from a wax in its entirety, a relatively large quantity of wax is required for the production of tree. A more serious problem of the conventional casting tree is that the sprue rod of solid wax is not so strong as to ensure easy handling of the tree. Care must be paid when the tree is transported or conveyed by grasping the neck portion of the sprue rod, leading to reduction in efficiencies during the transportation and conveyance operations. Furthermore, a skillful operation is required for mounting the tree on an apparatus for applying the ceramic shell coating layer.

Another disadvantage of the conventional tree is that the ceramic shell coating, which is formed by coating a refractory material on the tree followed by drying, tends to be cracked by the action of thermal expansion of the wax during the dewaxing step of heating to melt the wax masters contained in the thus formed ceramic shell coating unless careful consideration is paid to avoid the adverse influence of thermal expansion. This problem, i.e. cracking of the ceramic shell coating layer caused by the thermal expansion of wax, is a troublesome one particularly in the ceramic shell mold process wherein the shell coating layer is not supported by a back-up mass. In order to solve this problem, it has been a common practice to heat the tree rapidly so that the boundary surface portions of the wax masters contacting with the interior surface of the ceramic shell coating are immediately melted to flow out of the ceramic shell coating layer before the whole mass of the wax masters is heated to increase the volume thereof by thermal expansion to an extent for causing the cracking problem. However, the cracking problem caused by thermal expansion has not yet been solved even by skillful heating, since a large amount of molten wax flow is formed by the molten sprue rod which is made from a wax in its entirety.

OBJECTS AND SUMMARY OF THE INVENTION

Accordingly, a principal object of this invention is to overcome the aforementioned disadvantages of the conventional casting tree by the provision of an improved casting tree of novel construction.

Another object of this invention is to provide an improved casting tree which may be prepared by the use of a considerably small quantity of wax.

A further object of this invention is to provide an improved casting tree having a stiff and strong sprue rod portion made of a substantially rigid tubular member to ensure easy handling.

A still further object of this invention is to provide an improved casting tree for excluding the formation of cracking during the dewaxing step.

Yet a further object of this invention is to provide an improved casting tree which may be heated to melt the wax masters by high frequency heating at the dewaxing step.

With the aim to attaining the aforementioned objects, the present invention provides an improved casting tree comprising a sprue rod and a plurality of wax masters fused to said sprue rod, wherein said sprue rod comprises a tubular member made of a substantially rigid material and having the wall provided with a plurality of pores, the outer wall of said tubular member being covered with a wax covering layer.

According to an important aspect of a preferred embodiment, said substantially rigid material is a metal which may be heated by high frequency heating.

DESCRIPTION OF THE DRAWINGS

The above and other objects of the invention will become apparent from the following detailed description thereof with reference to the appended drawing, wherein.

DESCRIPTION OF THE PREFERRED EMBODIMENTS

The construction and use of the casting tree of the invention will be described in detail with reference to FIGS. 1 to 4 showing the substantially rigid tubular member after being processed through respective steps for preparing the ceramic shell mold to be used in a ceramic shell molding process, in order to facilitate full understanding of the merits of the invention.

Figure 1:
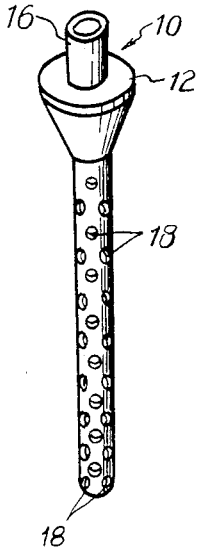
FIG. 1 is a perspective view of the substantially rigid tubular member.
Figure 2:
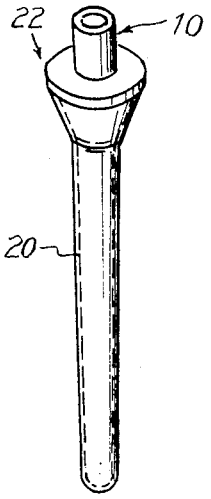
FIG. 2 is a perspective view of the sprue rod prepared by covering the tubular member with a wax layer.

Firstly referring to FIG. 1, an iron tubular member 10 has one end closed and the other end opened, with the peripheral wall being tapered slightly so that the open end portion of the tubular member 10 has a diameter larger than that of the closed end portion. A flange 12 of truncated cone shape is attached to a portion adjacent to the open end of the tubular member 10 to form a conical sprue port 14 (see FIG. 4) after the tubular member 10 is drawn from the finished ceramic shell mold. The portion 16 of the tubular member 10 upside of the flange 12, as viewed in FIG. 1, serves as a handle to be grasped by an operator or by a handler of a handling machine. A portion of the tubular member 10 downside of the flange 12, as viewed in FIG. 1, serves to form a header or main runner in the finished ceramic shell mold, and is provided with a number of small pores. The end face of the closed end of the tubular member 10 is also provided with a plurality of small pores 18. The diameter of these pores ranges generally from 1.0 mm to 6.0 mm, and preferably from 2.5 mm to 3.5 mm.

By dipping the tubular member 10 in a molten wax contained in a molten wax bath (not shown) by grasping the handle portion 16 and then withdrawing the member 10 out of the bath, the outer periphery of the tubular member 10 is covered with a wax layer 20, while the major portion of the wax penetrating into the hollow cylindrical portion of the member 10 flows out thereof through the pores 18 provided on the end face of the closed end. A wax covering layer 20 of sufficient thickness is thus formed to cover the conical periphery of the flange 12 and also to cover contiguously the portion of the tubular member 10 from the portion adjacent to the flange 12 to the end face thereof, whereby a sprue rod 22 covered with the wax covering layer 20 is prepared. The thickness of wax covering layer ranges generally from 0.5 mm to 2.0 mm, and preferably from 0.8 mm to 1.2 mm. In order to reduce the quantity of molten wax penetrating into the hollow cylindrical portion of the tubular member 10, the diameter of the pores 18 may be decreased, or the pores provided on the end face of the closed end of the tubular member 10 may be sealed by appropriate means when the tubular member 10 is dipped in the molten wax bath.

Figure 3:
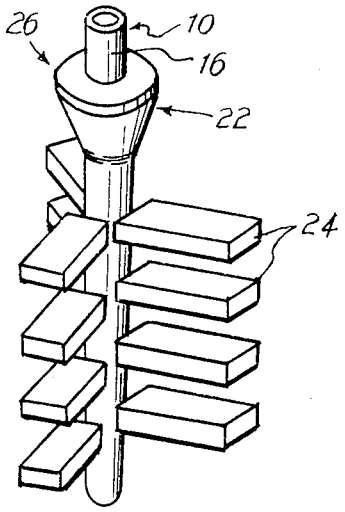
FIG. 3 is a perspective view of the assembled casting tree prepared by attaching a plurality of wax masters to the sprue rod.

A plurality of wax masters 24 molded, for example, by the known die casting process is mounted on a jig (not shown). Then, the portions of the wax masters 24 for forming the sprue runner portions in the finished ceramic shell mold are immersed in a molten wax bath while holding the wax masters 24 by the jig, followed by pressing the thus melted portions of respective wax masters onto the sprue rod 22 to be fused together. After the wax is solidified, the wax masters 24 are removed from the jig to leave them attached to the sprue rod 22 to complete the production of a tree 26 according to the present invention, as shown in FIG. 3.

The tree 26 may be transported or conveyed by grasping the handle portion 16. Since the wax forming the wax covering layer 20 penetrates through the pores 18 into the interior of the tubular member 10, the wax covering layer 20 is firmly held by the rigid tubular member 10 and prevented from unintentional separation from the tubular member 10. The tree 26 may be conveniently handled during the conveyance step by inserting a carrier bar into the tubular member 10 to hold the tree 26.

Figure 4:
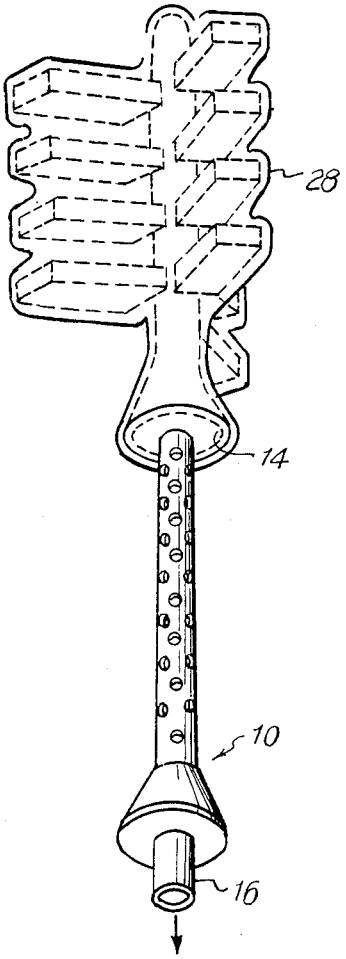
FIG. 4 is a perspective view showing the finished ceramic shell mold during the course of the dewaxing step.

Thereafter, the tree 26 is coated with a refractory material. After removing the releasing agent, oils or fats adhering on the surface of the tree by rinsing with a cleaning liquid, such as acetone or alcohols, the tree 26 is dipped in a slurry containing a refractory binder and fine particles of a refractory material. After draining the excess slurry, a dry powder of refractory material is applied over the tree wetted by the slurry followed by drying. The steps of dipping in the slurry, applying with a dry refractory powder and subsequent drying, are repeated for several times to form a shell coating layer having a desired thickness, whereby a ceramic shell mold 28 shown in FIG. 4 is prepared. The preparation of ceramic shell mold has been well known in the art, and a more detailed description thereof will not be given herein for the simplicity of the description.

At the next step, the tree 26 applied with the shell coating layer is heated while the tubular member 10 is held in the position with the open end thereof facing downside, as shown in FIG. 4. At this step, the iron tubular member 10 is withdrawn from the ceramic shell mold 28 immediately after the wax covering layer 20 is softened by heating to facilitate easy removal of the molten wax through the void core formed by the withdrawal of member 10. Even if the wax masters 24 are thermally expanded at some extent before the tubular member 10 is withdrawn, the softened or melted wax get into the hollow cylindrical portion of the tubular member 10 through the pores 18 to prevent the ceramic shell mold 28 from being applied with inflating force which might cause cracking of the wall of the ceramic shell mold 28.

It is desirous that the heating at this step is as rapid as possible to prevent cracking of the ceramic shell mold 28. According to a further advantageous feature of the invention, the iron tubular member 10 is heated, for example, by high frequency heating to melt the wax covering layer 20 contacting with the iron tubular member 10 before the wax is heated, and then the tubular member 10 is withdrawn. Thereafter, the wax contained in the ceramic shell mold 28 can be heated not only through the shell mold coating but also from the void core left by the withdrawl of tubular member 10. The risk of cracking of the ceramic shell mold 28 is thus excluded.

The thus prepared ceramic shell mold 28 is then used in the casting step where a molten metal is poured from the sprue port into the ceramic shell mold 28, followed by removal of the shell mold. The thus molded products are then subjected to the cutting and finishing steps to produce the finished products.

Although a particularly remarkable merit may be obtained when the tree of the invention is used in the ceramic shell molding process, it should be appreciated that the present invention may be applied in the solid molding process to give advantageous results. An iron tubular member 10 is used in the preceding embodiment for the convenience of high frequency heating. However, other metals or alloys, such as a light weight aluminum alloy, may be used in lieu of iron, and non-metallic materials may be used for the material for the substantially rigid tubular member 10. A tubular member having a cross section of generally square or rectangular shape may be used in place of the tubular member 10 having a substantially circular cross section as used in the preceding embodiment.

As has been described hereinbefore, the tree according to the present invention is prepared by forming a sprue rod including a substantially rigid tubular member provided with a number of small pores piercing through the peripheral wall thereof and a wax covering layer of sufficient thickness applied over the periphery of the tubular member, and then assembling a pre-set number of wax masters with the sprue rod by fusing. With such construction, the core portion of the thus formed sprue rod is hollow to make it possible to decrease the quantity required for the preparation of the tree. This provides a remarked merit from the economical viewpoint particularly when the dewaxing step is operated under the conditions not to allow the reuse of wax material. Since the handle portion of the sprue rod is integrally formed of a substantially rigid material which permits less scrupulous handling without the fear of scarring or otherwise impairing the portions made of wax, easy and safe transportation or conveyance of the assembled tree is ensured. Moreover, the adverse affect of thermal expansion caused by the thermal expansion of wax mass at the dewaxing step can be released by allowing the softened or melted wax to flow into the hollow cylindrical portion of the tubular member to diminish the risk of cracking otherwise experienced to result in damage of the ceramic shell mold. The shell coating layer can be more effectively prevented from cracking, according to a further advantageous feature of the invention, initially by heating only the tubular member made of a magnetic material, such as iron, to permit withdrawal of the tubular member and then heating the mass of wax masters not only from the outside of the ceramic shell coating layer but also directly from the void core portion formed by the withdrawal of tubular member.

Although the present invention has been described by referring to the specific embodiment as illustrated in the appended drawing, by way of example, it should be appreciated that the invention is not limited only to the illustrated embodiment but many changes and modifications may be made without departing from the spirit and scope of the invention and all such changes or modifications are intended to be embraced within the scope of the invention as defined in the appended claims.

What is claimed is:

1. A casting tree for a ceramic shell mold casting comprising a sprue rod and a plurality of wax masters fused at predetermined locations to said sprue rod, an improvement wherein said sprue rod comprises a hollow tubular member made of a metal material and having a plurality of pores in the wall and having a plurality of pores in the end face of said tubular member, the locations of said pores on said sprue wall being uncoordinated with said predetermined location, the outer wall and the end face of said tubular member being covered with a wax covering layer.

2. The casting tree according to claim 1, wherein said metal is a material adapted to be heated by high frequency heating.

3. The casting tree according to claim 2, wherein said metal is iron or an alloy thereof.

4. The casting tree according to any of claim 1, wherein each of said pores has a diameter of from 1.0 mm to 6.0 mm.

5. The casting tree according to any of the claims 1, 2 or 3, wherein said wax covering layer has a thickness from 0.5 mm to 2.0 mm.

* * * * *